United States Patent [19]

Gidge

[11] 4,232,725

[45] Nov. 11, 1980

[54] PASS-THROUGH WEATHER CURTAIN FOR GARAGES AND THE LIKE

[75] Inventor: Kenneth Gidge, Nashua, N.H.

[73] Assignee: BSL Corporation, Nashua, N.H.

[21] Appl. No.: 966,878

[22] Filed: Dec. 6, 1978

[51] Int. Cl.[3] ..... A47H 1/00

[52] U.S. Cl. ..... 160/332

[58] Field of Search ..... 160/184, 330, 332, 349 R; 49/9, 34

[56] References Cited

U.S. PATENT DOCUMENTS

| | | | |
|---|---|---|---|
| 2,041,258 | 5/1936 | Mitchell | 160/184 |
| 2,392,755 | 1/1946 | Michaels | 49/34 |
| 3,035,275 | 5/1962 | Strebeigh | 160/330 |
| 3,331,425 | 7/1967 | Groves et al. | 160/184 |
| 3,809,144 | 5/1974 | Garufo | 160/184 |
| 4,091,857 | 5/1978 | Jacobs | 160/330 |

*Primary Examiner*—Peter M. Caun

*Attorney, Agent, or Firm*—Morse, Altman, Oates & Bello

[57] ABSTRACT

A curtain is provided for use across the doorway of a garage, or the like, through which vehicles may pass easily but which substantially blocks out ambient weather conditions. The curtain provides a barrier which retains building heat during the winter and cool air during the summer and reduces entry of cold air in the winter and warm air in the summer. The curtain is comprised of a single main panel suspended across the upper portion of the doorway and a plurality of a relatively narrow, overlapping strips suspended from the lower edge of the fixed panel. Wide strips and/or one or more layers of narrow strips are provided at the sides to reduce heat transfer through the sides of the curtain. A breakaway line extends across the mid portion of the doorway opening to prevent the curtain from billowing inward in the event of unusually high wind gusts.

9 Claims, 13 Drawing Figures

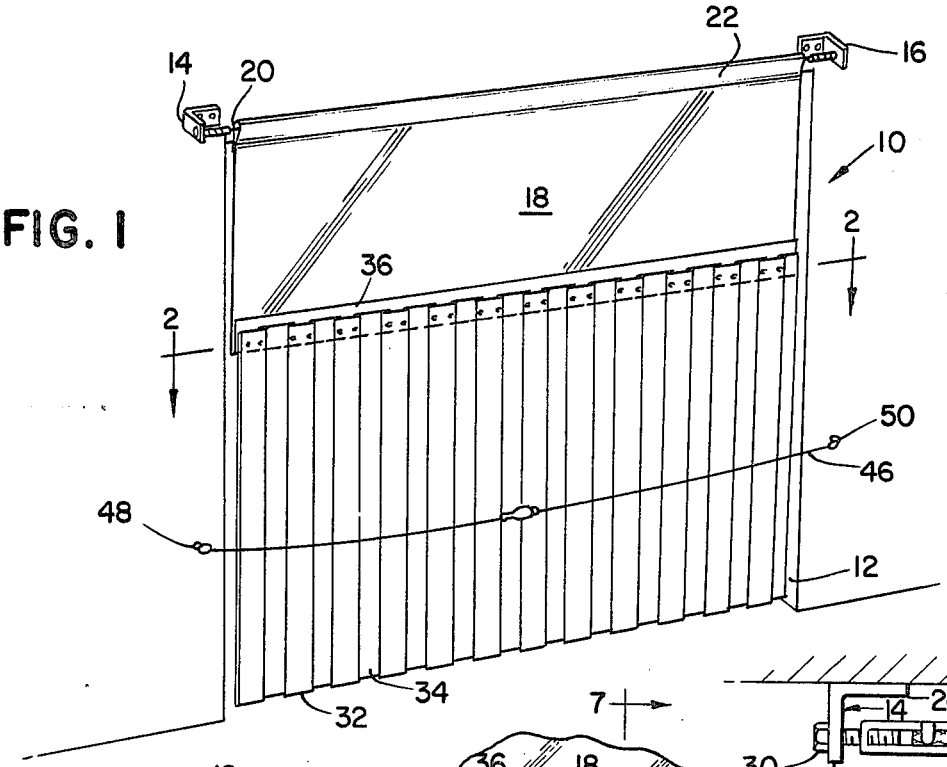
FIG. 1
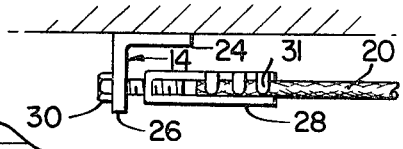
FIG. 5
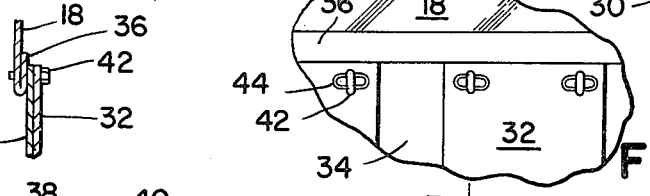
FIG. 6
FIG. 7
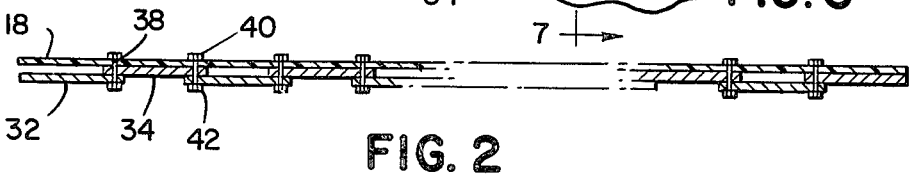
FIG. 2
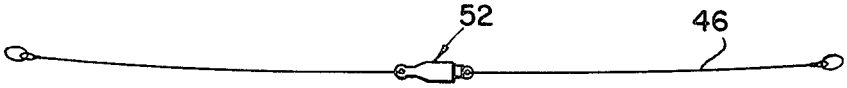
FIG. 3
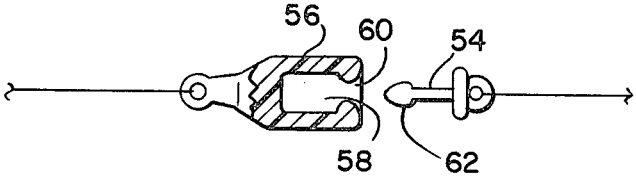
FIG. 4

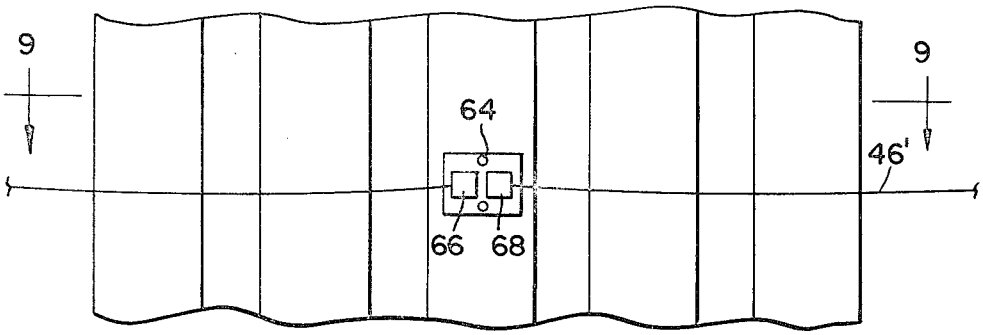
FIG. 8
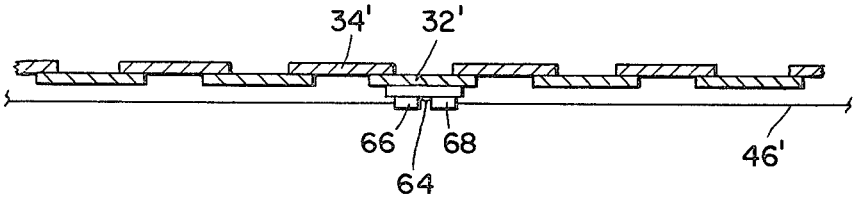
FIG. 9
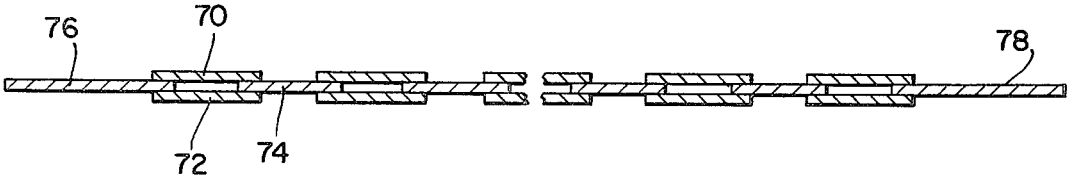
FIG. 10
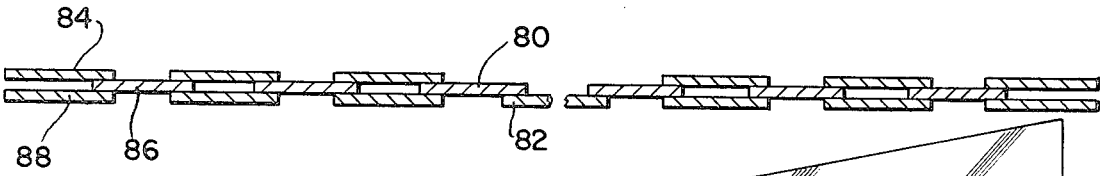
FIG. 11
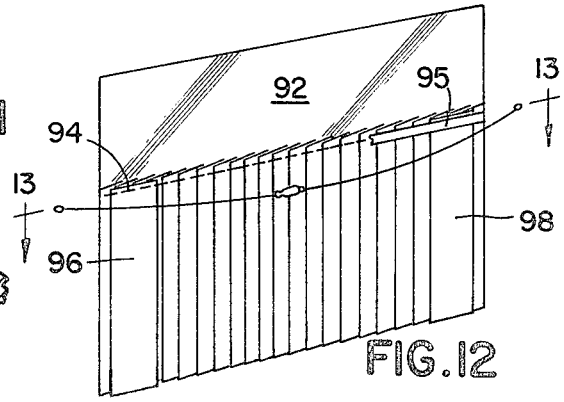
FIG. 12
FIG. 13
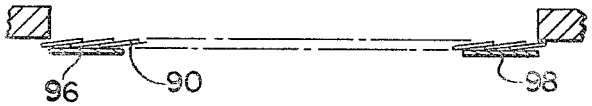

PASS-THROUGH WEATHER CURTAIN FOR GARAGES AND THE LIKE

BACKGROUND OF THE INVENTION

1. Field of the Invention

This invention relates generally to curtain structures and more particularly is directed towards an improved pass-through weather curtain for use across garage door openings and the like.

2. Description of the Prior Art

In many types of buildings such as gasoline service stations, automobile garages, warehouses, truck depots, and the like, it is frequently necessary that the doorway be kept open during normal working hours or for extended periods in order to allow vehicles and personnel to move freely in and out of the building. In automobile service stations and garages, for example, the doorways usually are quite large to accommodate the vehicle and, typically, overhead doors are used. These doors normally are kept raised for long periods of time because of the inconvenience involved in opening and closing the doors each time a vehicle has to pass through. However, because of the large size of the doorway, it is extremely difficult during cold weather to maintain a comfortable temperature level within the building. Similar problems occur in the hot weather where the building is air conditioned, since even if the door is opened and closed quickly there is a large loss of heat in the winter and air conditioned air in the summer each time the door is operated.

In U.S. Pat. No. 3,331,425 there is disclosed a pass-through curtain having a relatively large, single upper panel mounted by upper and lower transverse rods to the upper portion of the doorway opening. A few relatively large lower panels are detachably connected and freely suspended along the lower edge of the upper panel and through which vehicles may pass. A pulley system is provided to raise and lower the curtain to accommodate large trucks and the like.

While the curtain in the above-identified patent functioned reasonably well in calm weather, the lower panels were susceptible to sailing or billowing in and out during windy weather, with the result that the intended purpose of the curtain was defeated. Also, the rod arrangement and pulley system tended to be somewhat cumbersome and expensive.

Accordingly, it is an object of the present invention to provide a new and improved pass-through weather curtain for use across doorways and the like.

Another object of this invention is to provide a transparent, substantially draft-free barrier which permits the free movement of solid objects therethrough.

A further object of this invention is to provide a simple, low cost, pass-through curtain that is highly resistant to displacement by wind.

SUMMARY OF THE INVENTION

This invention features a pass-through weather curtain for use across doorways such as garage door openings, or the like, comprising a relatively large, single, upper panel, suspended across the upper portion of the doorway by means of a cable stretched between a pair of brackets, and a plurality of relatively narrow strips freely suspended from the lower edge of the upper panel and arranged in overlapping relation. Wide strips and/or one or more layers of narrow strips are provided at the side portions of the curtain to reduce heat transfer along the sides of the door and control the motion of the curtain. A line is stretched across the mid-portion of the door opening transversely of the curtain with the ends thereof attached to the door frame. A breakaway coupling is provided, preferably at the center of the line, whereby the curtain may be held in place against unusually high winds and yet will separate when a vehicle or the like passes through the door opening.

BRIEF DESCRIPTION OF THE DRAWINGS

FIG. 1 is a view in perspective of a pass-through weather curtain and associated equipment made according to the invention, FIG. 2 is a cross-sectional view taken along the line 2—2 of FIG. 1, FIG. 3 is a view in front elevation of the breakaway line employed in the invention, FIG. 4 is a detailed sectional view of the breakaway coupling shown in FIG. 3, FIG. 5 is a detail top plan view of a curtain mounting bracket, FIG. 6 is a detail front view of the curtain at the juncture of the strips and main panel, FIG. 7 is a cross-sectional view taken along the line 7–7 of FIG. 6, FIG. 8 is a detail front elevation showing a modified breakaway arrangement, FIG. 9 is a cross-sectional view taken along the line 9—9 of FIG. 8, FIG. 10 is a view similar to FIG. 2 showing a modified curtain arrangement, FIG. 11 is a view similar to FIG. 2 showing yet another modification of the curtain, FIG. 12 is a view in perspective showing still another modification of the invention, and FIG. 13 is a cross-sectional view taken along the line 13—13 of FIG. 12.

DETAILED DESCRIPTION OF THE PREFERRED EMBODIMENTS

Referring now to the drawings and to FIG. 1 in particualr, the reference character 10 generally indicates a pass-through curtain assembly suspended across a relatively large doorway 12 by brackets 14 and 16 mounted to the wall or frame of the doorway opening near the top thereof. The curtain is generally organized about a relatively large rectangular upper main body panel 18, preferably fabricated from a flexible, transparent plastic sheet of 20 gauge polyethylene or the like. The main body panel 18 is of a width and height sufficient to span the upper portion of the doorway opening 12 with several inches of overlap around the margins thereof when the curtain is suspended in position. While the height of the panel 18 may be varied it has been found that for a typical garage door opening a height of 2½ feet provides adequate clearance for most vehicles.

The panel 18 is suspended in position by means of a wire cable 20 or the like stretched between the brackets 14 and 16. The panel 18 is formed with a tubular fold 22 along its upper edge and through which the cable 20 extends. Typically, the panel material is thermoplastic so that the tubular fold is readily formed by heat sealing techniques, for example.

The cable 20 may be connected to the brackets 14 and 16 by various means which will allow adjustments in the length and tension of the cable so that, using a single bracket system, a cable may be cut to length to fit a variety of different width doorways and curtains of different widths. As best shown in FIG. 5, there are illustrated details of the bracket 14 by means of which the cable tension may be adjusted. The bracket 14 is an L-shaped member, preferably of steel, with one leg 24 securely fastened to the wall or frame of the building by means of screws, or the like, while the other leg 26 extends perpendicularly from the face of the wall. A coupling device 28 is attached to the leg 26 by means of a take-up screw 30 at one end while the other end engages the cable.

The coupling device includes a plurality of spaced crimping fingers 31 which are generally arcuate and form part of a tubular socket at the end of the coupling to receive the end of the cable. The cable is inserted in the tubular socket and one or more fingers 31 are crimped against the cable to secure it in place. Tension adjustment may be made by turning the screw 30 in order to move the coupling 28 to or away from the bracket arm 26.

Freely suspended from the lower edge of the main upper panel 18 are relatively narrow strips 32, 34 arranged in spaced, overlapping layers and extending across the full width of the panel 18 and the doorway opening, as shown. Typically, and in the preferred embodiment of the invention, each strip 32 is approximately 6–8" in width with a length sufficient to extend from the lower edge of the panel 18 to the floor or ground level such that the strip will hang straight in the manner shown. The spacing between adjacent strips in each layer preferably is about 2" with the strips being overlapped as best shown in FIG. 2 so that there are no gaps between strips.

The strips 32 preferably are fabricated from a transparent flexible plastic material in the range of 12–20 gauge which may be similar to or the same as that used in the main upper panel 18, although perhaps of a greater thickness in view of the fact that the strips will be subjected to greater wear and tear than the panel 18 as a result of the traffic flow. Also, the strips preferably are relatively heavy in order to improve stability of the strips against movement due to wind.

The strips in the illustrated embodiment are detachably connected to the lower margin of the panel 18 by suitable fastening means. Preferably, the connecting arrangement between the strips and the panel 18 include a folded lower margin 36 of the panel 18 through which extend a row of fasteners 38 having enlarged heads 40 at one end and twist locks 42 at the other end. The twist locks pass through oval shaped grommets 44 fastened near the upper ends of the strips, typically with two grommets per strip, as best shown in FIG. 1 and 2. The grommets may be of brass, steel, aluminum or the like and serve to prevent ripping and tearing of the plastic at these stress points. Each fastener stud extends through the folded margin 36, inner strip 34 and an outer strip 32 as shown in FIG. 2. Individual strips may be readily replaced by manipulating the twist locks associated with the strip, removing the strip and then replacing it with a fresh strip.

It has been found that by using a relatively large number of narrow, overlapped strips, in the manner show, rather than a few relatively large curtains sections, the curtain does not tend to billow in or sail whenever struck by a strong gust of wind. A curtain made with many narrow strips when struck by a wind gust, remains substantially in place with some minor separation of the strips which permits some wind to pass through without forcing the entire curtain out of position. Also, since the curtain is suspended from the top edge of the upper panel, it is unnecessary to raise and lower the entire curtain whenever an oversized vehicle is passing through the doorway since the vehicle can displace the entire curtain and the curtain will return to its original position after the vehicle has passed through.

In the event of a particularly windy day, where it may be desirable to utilize the curtain in lieu of closing the door, a further restraint against curtain displacement is provided by a breakaway cord 46 stretched across the lower portion of the doorway, as best shown in FIG. 1. The cord 46 is secured at its ends by suitable fasteners 48 and 50 at a height preferably about halfway of the height of the strips and extending in close proximity to the strips on the inside of the curtain. Thus, any heavy wind tending to force the curtain inwards will be resisted by the breakaway cord 46. The cord 46 is, however, designed to separate so that a vehicle may pass through the doorway without first disconnecting the cord. The cord is provided, preferably at the center thereof, with a breakaway coupling 52 which, in the embodiment shown in FIG. 3 and 4, is comprised of male and female members 54 and 56 which plug one into the other in a releasable fashion. Preferably, the female member 56 at least is formed of a resilient material, such as plastic or the like, and has a socket 58 at the end thereof with an annular shoulder 60 around the mouth of the socket. The male member 54 is formed with an enlarged head portion 62 which plugs into the socket in a releasable fashion. The male and female members will hold together under normal pressure, but under sufficient applied force, such as by a vehicle entering through the doorway opening, the parts will separate without breaking the cord. Thus, the vehicle can move through the opening. Optionally, the cord may be located at a higher location near the lower edge of the main panel 18 in order to stabilize the upper portion of the curtain and allow normal use for the lower portion.

In place of the male and female coupling arrangement shown in FIGS. 3 and 4, other breakaway connections may be provided. For example, magnetic elements may be provided to hold the cord ends together, spring release mechanisms, Velcro fasteners and other devices may be used to advantage. For example, there is shown in FIGS. 8 and 9 a breakaway connection utilizing magnetic components. In this embodiment a plate 64 is attached to a center strip 32', preferably at a height several feet above floor level. The plate 64 may be a magnetic element or may be of magnetically attractive material such as soft iron, or the like. Preferably, the plate 64 should be of a material that will not damage the finish of a vehicle passing through the curtain and, for this purpose, a rubberized or plasticised magnetic material is preferred since it is somewhat flexible and resilient and provides a strong magnetic action with ferrous metals as well as with similar rubber or rubber-like magnets.

Cord sections 46' extend from both sides of the doorway opening as in the FIG. 1 embodiment and the free ends, instead of connecting to one another at the center, attach to the plate 64. The free ends are provided with magnetically attractive heads 66 and 68 which releasably attach to the face of the plate 64, as shown. The heads 66 and 68 may be either of a ferrous material or a rubberized magnet as previously indicated. The breakaway arrangement functions in a fashion similar to that of the principal embodiment and serves to hold the curtain strips in place to resist high wind gusts, yet allows the cord sections to separate when a vehicle passes through the opening.

Referring now to FIG. 10 of the drawings, there is illustrated a modified curtain arrangement for reducing air flow through the curtain. In FIG. 10, the curtain is comprised of three layers of vertical strips suspended from the lower edge of a single upper panel in a manner similar to the principal embodiment. However, in lieu of two layers of strips as in FIG. 1, three layers of strips are employed with two outer layers 70 and 72 arranged in overlapping relationship with respect to a center layer of strips 74. In practice, the outer strips 70 and 72 may be on the order of perhaps 8" in width while the center strips 74 are on the order of perhaps 6" in width. These dimensions are only by way of example and may be modified. When using the three layer arrangement FIG. 10, the strips may be of a somewhat thinner and/or lighter material than the strips used in the two layer arrangement of the principal embodiment. At each side of the curtain a single relatively wide strip 76 and 78 is provided, these strips being perhaps several feet in width. The function of the two wide side strips is to provide a more impermeable barrier to air at the sides which is subject to less traffic than the center of the curtain while the multiple layer section in the center separates easily while improving insulation when hanging straight.

In FIG. 11 there is shown a modified arrangement for achieving an effect similar to that provided by the FIG. 10 curtain. In FIG. 11 the curtain is formed with two layers of overlapping strips 80 and 82 in the center portion of the curtain, while near the sides, the curtain is formed with three overlapping layers of strips 84, 86 and 88.

Referring now to FIGS. 12 and 13, there is illustrated another modification of the invention, and, in this embodiment a number of narrow strips 90 are suspended from a main single upper panel 92 in an overlapping shingle arrangement best shown in FIG. 13. The strips preferably are 6–8" in width and of a 12–20 gauge clear flexible plastic such as polyethylene. The strips are attached to the panel 92 by sewing them directly to the panel margin as indicated by seam 94. In practice the seam is covered by a strip of tape 95, preferably a tough, aluminized pressure sensitive tape, to protect the threads from wear by automobile antennae rubbing against them. One or two relatively wide (12–16") panels 96 and 98 are suspended at both sides of the curtain to provide an extra barrier for reducing air flow around the sides of the curtain. These wider panels may be positioned at the very ends of the curtain next to the door frame or they may be set in from 1 to 3 feet from the ends of the curtain.

While the invention has been described with particular reference to the illustrated embodiments, numerous modifications thereto will appear to those skilled in the art. For example, in place of the wire cable and bracket arrangement for mounting the curtain, a suspension system using a rigid pipe may be used. Such a pipe may be suspended horizontally from overhead door tracks by suitable pipe hangers with the pipe being threaded through the tubular fold in the top of the curtain.

Having thus described the invention, what I claim and desire to obtain by Letters Patent of the United States is:

1. A curtain for use across doorways or the like, comprising (a) a single rectangular upper panel of a flexible and substantially imperforate material of a width sufficient to extend entirely across said doorway and of a height sufficient to cover a substantial portion of the upper part of said doorway, (b) mounting means engaging the upper marginal edge of said panel for freely suspending said panel by its upper edge across the top of said doorway, (c) a plurality of relatively narrow rectangular elongated flexible strips all freely suspended in overlapping relation from the lower edge of said upper panel, (d) said strips including means defining a graduated barrier to the circulation of air through said doorway which barrier is greater at the side portions of said curtain strips than at the center portion thereof, (e) said strips being arranged in a single course of overlapping strips, each strip extending behind one adjacent strip and in front of another adjacent strip and said means including at least one relatively wide strip at each side of said curtain, (f) said means including a greater number of layers of said strips at the side portions of said curtain than at the center portion thereof.

2. A curtain according to claim 1 wherein said mounting means includes a cable engaging the upper edge of said upper panel and brackets mountable in fixed position adjacent said doorway and connected to the ends of said cable.

3. A curtain according to claim 2 wherein said brackets include adjustment means for changing the tension on said cable.

4. A curtain according to claim 1 including a breakaway cord extendable across said doorway and adjacent said curtain.

5. A curtain according to claim 4 wherein said cord includes a releasable coupling means normally holding said cord in position and adapted to separate under applied pressure.

6. A curtain according to claim 5 wherein said coupling means includes mutually magnetically attractive members mounted respectively to the center of said curtain and at each opposing end of a pair of cord sections extensible across the width of said curtain.

7. A curtain according to claim 1 wherein three layers of flexible strips are suspended from the lower edge of said upper panel with the strips in the inner layer being narrower than the strips in the outer layers.

8. A curtain according to claim 1 wherein said strips are arranged in at least two layers with the strips in each layer being spaced apart from one another by a distance less than the width of said strips.

9. A curtain according to claim 1 wherein said strips are sewn to said upper panel to form a transverse seam across the top of said strips and the lower margin of said upper panel, and a strip of pressure sensitive tape applied over said seam.

* * * * *